United States Patent [19]

Bogan

[11] 4,033,073

[45] July 5, 1977

[54] SHUTTER, GRILLE OR THE LIKE

[76] Inventor: Robert T. Bogan, P.O. Box 26208, Albuquerque, N. Mex. 87125

[22] Filed: Jan. 9, 1976

[21] Appl. No.: 647,660

[52] U.S. Cl. ..... 49/38; 160/197; 160/222

[51] Int. Cl.[2] ..... E06B 7/02

[58] Field of Search ..... 160/197, 202, 205, 211, 160/214, 222, 223, 225, 228, DIG. 16; 49/38, 55, 56, 62

[56] References Cited

UNITED STATES PATENTS

| | | | |
|---|---|---|---|
| 702,094 | 6/1902 | Fleming | 160/228 |
| 949,600 | 2/1910 | Rylander | 49/38 |
| 1,029,814 | 6/1912 | Manning | 49/38 |
| 3,153,819 | 10/1964 | Bond | 160/DIG. 16 |

*Primary Examiner*—Peter M. Caun

*Attorney, Agent, or Firm*—Horace B. Van Valkenburgh; Frank C. Lowe

[57] ABSTRACT

A movable member of a grille or shutter is slidable with respect to a stationary member through tongue and groove or other slidable connections, between a fully open and a fully closed position. Both the movable member and the stationary member are provided with corresponding cross bars which are spaced both vertically and equally. Facing upright rails, such as at the center, of the movable member and fixed member are provided with opposed grooves, each for reception of a vertically placed bar magnet. The magnets are placed with their opposite poles facing each other, so that the magnets will attract, rather than repel. Preferably, the closed position of the movable member is the upper position, and the magnets are directly opposite each other in this position.

6 Claims, 6 Drawing Figures

SHUTTER, GRILLE OR THE LIKE

This invention relates to shutters, grilles and the like.

Shutters have, probably for centuries, been utilized to prevent the ingress of wind, rain, hail and the like through a window opening protected by a shutter. Shutters have possibly been used prior to the development of glass or other transparent material for windows. Often, a shutter is pivoted at one side, so as to swing open to that side, but a popular combination is a pair of shutters which, when closed, meet at the centerline of the window, being individually hinged at the opposite sides of the window. Normally, the shutter is either open or closed, since it is sometimes difficult to hold the shutter in a partially opened position, so that a desired amount of ventilation may be obtained. Also, the wind may be strong enough to push the shutter completely closed or open further than desired.

It has been proposed, as in U.S. Pat. No. 949,600, to provide a shutter which includes a slotted member movable relatively to a fixed slotted member, so as to cause the slots of the movable member to cover all or a portion of the slots of the fixed member, as desired. However, the actuating mechanism is rather cumbersome, while the positioning of a holding pin in different portions of a slot is awkward and cumbersome.

By the present invention, a shutter is provided which may be mounted for pivotal movement, such as from and to an area covering one half of a window, with a similar shutter pivoted at the opposite side of the window, or a grille may be placed in an upright position to form a divider between two areas of a home, office or the like. However, ventilation and light may be permitted to pass through the shutter or grille by placing a movable member at a position in which the openings or slots of the movable member coincide with openings or slots of the fixed member. The movable member may be placed at any intermediate position, since the movable member of the shutter or grille may be merely moved by hand to the desired position, but the movable member will remain in such desired position until moved again. In the open position, the movable member of the shutter or grille may be held by gravity, as in a lower position, but held in a closed or upper position by a pair of opposed, elongated magnets, each mounted in an upright position in a groove of the movable member and fixed member, respectively. Or, the movable member may be held by gravity in the closed position and by the magnets in open position. In general, the north and south poles of the opposed elongated magnets are reversed in position, so that opposite poles will be opposite each other, as when the movable member is in its upper position, and each magnet will thus tend to be attracted toward the other magnet. The strength of this magnetic force can be proportioned so that the movable member of the shutter can be readily moved by hand to overcome the force, but the magnetic force is still sufficient to retain the movable member in any position at which placed.

Additional details of the shutter or grille of this invention and other novel features thereof will become apparent from the following description, taken in conjunction with the accompanying drawings, in which.

Figure 1:
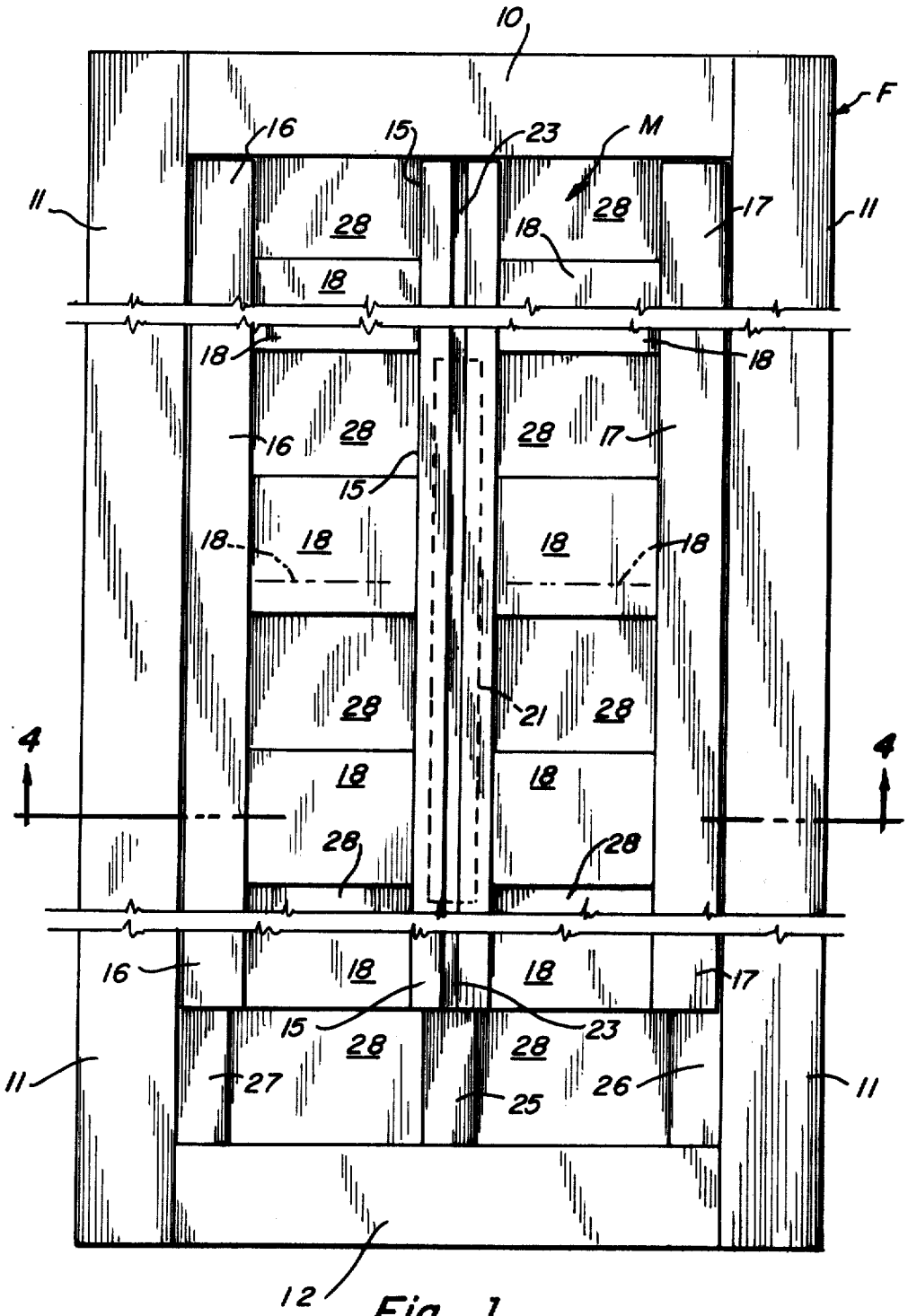
FIG. 1 is a condensed rear or inside view of a shutter or grille constructed in accordance with this invention but with the partially open position of FIG. 2 of one cross bar shown in dotted lines.
Figure 2:
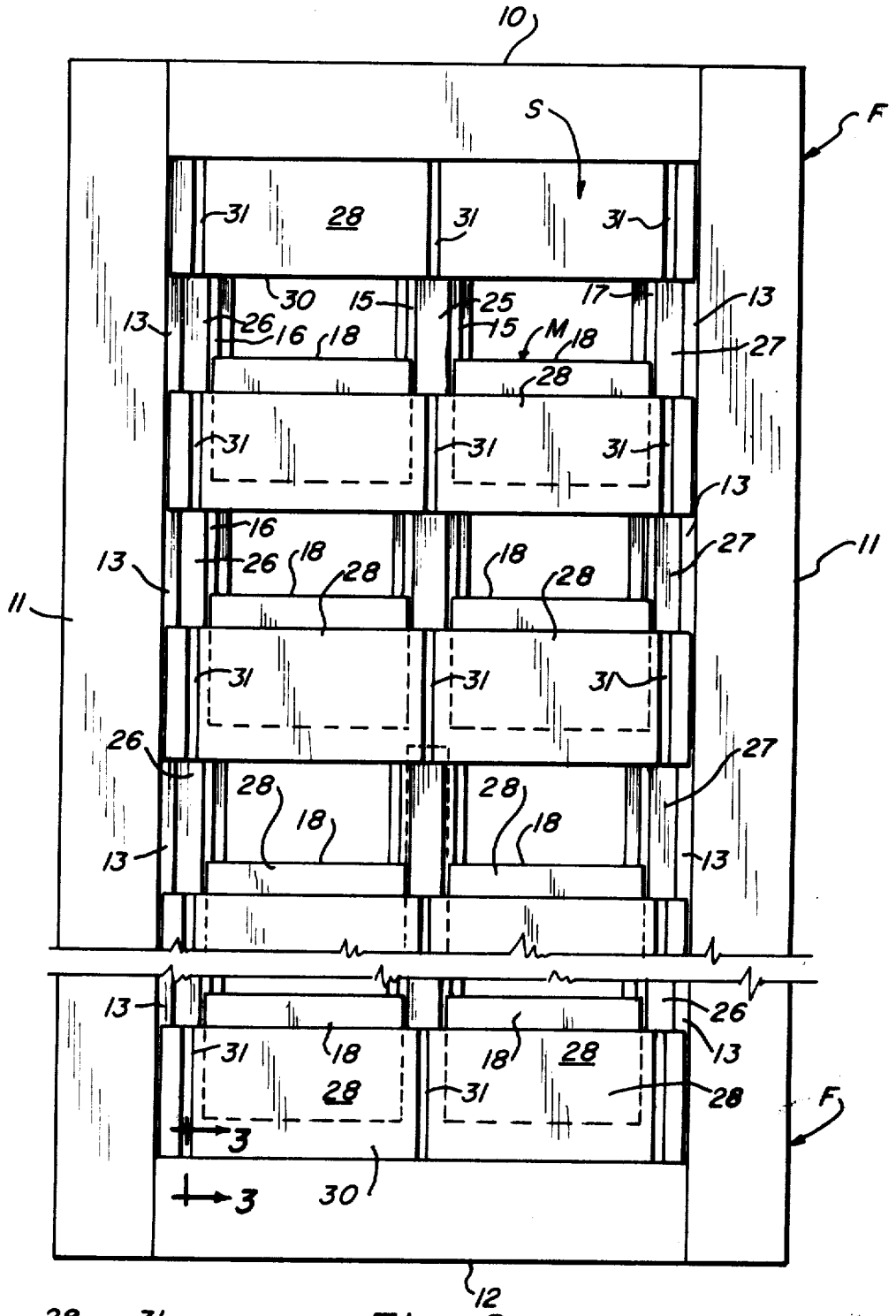
FIG. 2 is a condensed front or outside view of the shutter or grille, shown in a partially open position.
Figure 3:
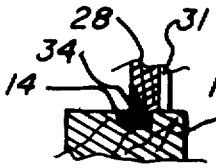
FIG. 3 is a fragmentary vertical section, taken along line 3—3 of FIG. 2.
Figure 4:
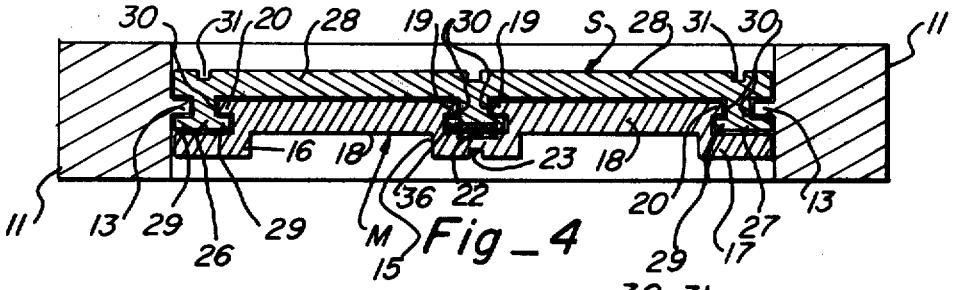
FIG. 4 is a cross section, taken along line 4—4 of FIG. 1 and particularly showing a pair of opposed magnets mounted in the respective stationary and movable members of the shutter or grille.
Figure 5:
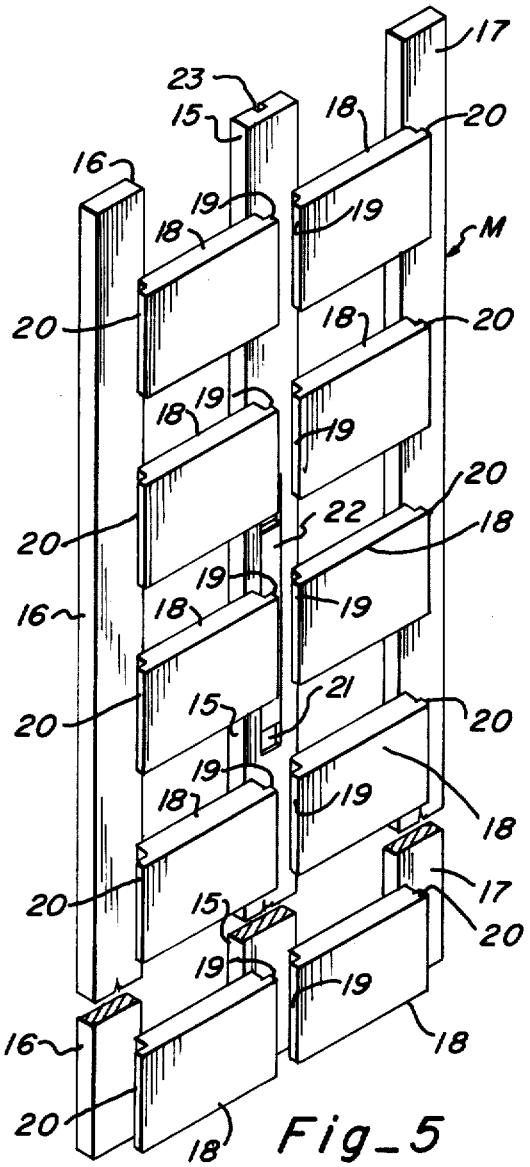
FIG. 5 is a condensed perspective view, looking at the side of the movable member which abuts the stationary member.

A shutter constructed in accordance with this invention may, as in FIGS. 1 and 2, include a frame F, a stationary or fixed member S which is on the outside of the shutter and a movable member M which is on the inside of the shutter, for access thereto by a person adjusting the shutter. For use as a shutter, one side edge of the frame F may be attached by a hinge to one side of a window frame and another shutter half to the opposite side of the window frame. For use as a grille, the frame F may extend from the floor to the ceiling of the room, or the frame may be supported in upright position, as by laterally extending legs adjacent the bottom. The frame F includes a top rail 10, a pair of side rails 11 and a bottom rail 12. Each side rail 11, as in FIG. 4 is provided with a tongue 13 facing toward the center of the shutter, for a purpose described below, while top rail 10 and bottom rail 12, as in FIG. 3, are each provided with a groove 14 which also faces toward the center of the shutter, for a purpose also described below. The movable member M of the shutter, as in FIG. 1, includes a center post 15 and side posts 16 and 17, with cross bars 18 extending between the posts and conveniently integral therewith, as in FIG. 4. The inner edges of the cross bars 18 at the position of center post 15, as shown in FIGS. 4 and 5, are each provided with a tongue 19 and the outer edges with a similar tongue 20 at the position of rails 16 and 17, for a purpose later described. The center post 15 is provided, on the side facing stationary member M, with a vertical groove 21 in which a magnet 22 is mounted, and also a vertical groove 23 on the opposite side, to minimize warpage due to magnet groove 21 and for decorative purposes.

Figure 6:
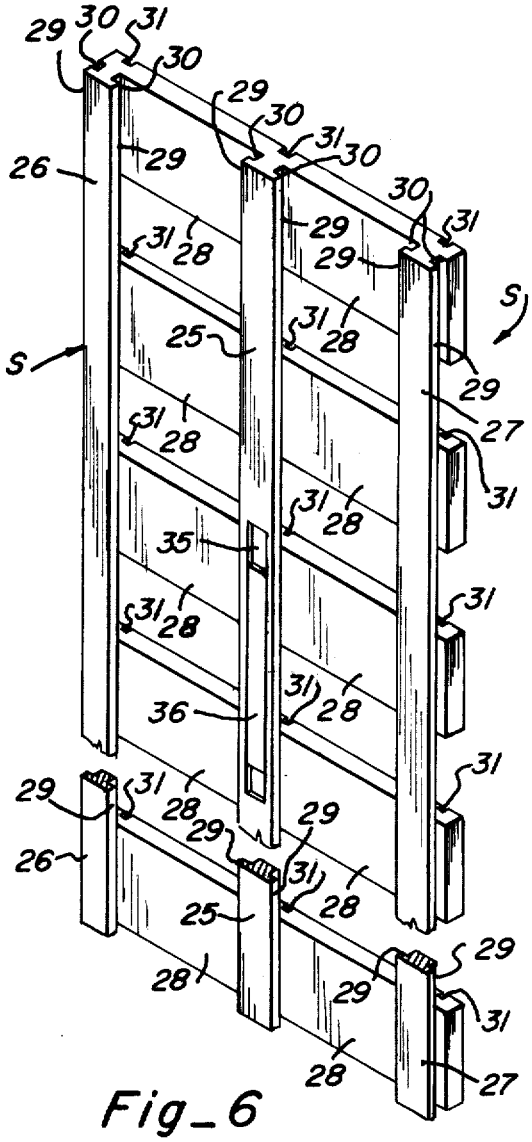
FIG. 6 is a condensed perspective view, looking at the inner face of the fixed or stationary member.

The stationary or fixed member S, as in FIGS. 2, 4 and 6, may include a center upright guide rail 25 and side upright guide rails 26 and 27, respectively, together with cross bars 28. Each side of each guide rail 25, 26 and 27 is provided with a vertical tongue 29 providing a groove 30 between the tongue 29 and the adjacent cross bar 28, to which rails the vertically spaced cross bars 28 are attached or may be integral therewith, as shown. Cross bars 28 may be spaced apart a distance slightly less than the height thereof and also have the same height as the cross bars 18 of the movable member which, in turn, may be spaced apart a distance slightly less than the height thereof. The outer surface of each cross bar 28, as in FIG. 1, is provided with a vertical groove 31 opposite each of the guide rails 25, 26 and 27, to relieve stress which might be concentrated due to the guide rails, and also for decorative purposes. As will be evident from FIG. 1, downward movement of the movable member M will cause the cross bars 18 to uncover more and more of the opening between adjacent cross bars 28 of the stationary member S. As in FIG. 4, each groove 30 at the outside of the stationary member S will engage a tongue 13 of the corresponding side rail 11 of the frame. This joint is preferably glued to maintain the stationary member of the frame in attached relation. In addition, a depending tongue 34 of the lower cross bar, as in FIG. 3, and a similar tongue of the upper cross bar 28, may extend into groove 14 in the bottom rail 12 and top rail 10, respectively, of the frame. Again, these joints may be glued in order to provide a dependable connection between the stationary member S and the frame, as in FIG. 2. As in FIG. 4, the tongues 20 of the movable member M fit into grooves 30 at the inside of the guide rails 26 and 27, while center tongues 19 fit into the opposed grooves 30 at the center guide rail 25. Also, the inner tongues 29 of outer rails 26 and 27 interfit with the grooves of the movable member formed between the adjacent tongue 20 and the rails 16 and 17, respectively, while each tongue 29 of the center rail 25 interfits with the groove formed between tongue 19 and center rail 15 of the movable member. Thus, the movable member is guided reliably during its upward and downward movement, both at the center and at the sides, but the fit between the tongues and grooves just referred to may be a sliding fit which produces only a slight amount of friction between the movable member and the stationary member.

The center guide rail 25 is provided, in the surface facing the movable member M, with an upright groove 35 in which is mounted a permanent magnet 36 which is preferably a duplicate of magnet 22 and is mounted opposite the position of magnet 22, such that the upper end of magnet 22 will be directly opposite the upper end of magnet 36 in its upper or closed position but with opposite polarity. As indicated previously, the magnets 22 and 36 should be place with opposite poles at the corresponding ends of the magnets, so that the magnets will attract each other, rather than oppose each other. Also, the length of the magnets should be at least twice, or greater than, the distance to which movable member M is moved between its fully closed and fully open positions. This is for the reason that the magnets should still attract each other when the movable member is moved such a distance. For example, for a movable member having cross bars 18 whose vertical dimension is approximately 2 inches and therefore the movable member will need to be moved 2 inches for movement between fully open and closed positions, a length of the magnets on the order of 6 inches has worked satisfactorily. Of course, the magnets could be longer. As also indicated previously, the magnets are spaced 2 inches apart in the example given, when the movable member is moved to the closed position, so that the magnets will still attract each other, but without quite the force exerted when the magnets are in exact end to end relationship.

An advantage of placing the magnets and movable member so that the magnets hold the movable member in an upper position is that the attraction of the magnets opposes the force of gravity and thereby assists the user in moving the movable member upwardly. Also, the attraction of the magnets assists in holding the movable member at any position intermediate the lower and upper positions. As will be evident, the greatest attraction of the magnets will be when the magnets are exactly opposite each other, with the attraction being reduced as the magnets move away from this position. However, when the movement is downward from the directly opposed position, the force of gravity assists in such movement.

It will be understood that, although a particular tongue and groove arrangement for the cross bars and rails of the movable and stationary members, for guidance during relative movement, has been described and illustrated, other guiding arrangements may be utilized. Also, although the use of three rails for each of the members has been described, it will be understood that less or more than three rails may be utilized, particularly for grilles which will normally be wider than shutters and therefore may accommodate five or more rails for each of the stationary and movable members, with appropriate changes in the location of the magnets. However, a center rail does provide a laterally balanced position for installation of the magnets.

Although a preferred embodiment of this invention has been illustrated and described and certain variations indicated, it will be understood that additional embodiments may exist and that various changes may be made therein, without departing from the spirit and scope of this invention.

What is claimed is:

1. A shutter, grille or like, comprising:

a stationary member having vertically and equally spaced cross bars connected by upright rail means including an upright center rail;

a movable member provided with corresponding vertically and equally spaced cross bars connected by upright rail means including an upright center rail, said cross bars of said movable member being in alignment with said cross bars of said stationary member when said movable member is in an open position and said cross bars of said movable member covering the spaces between said cross bars of said stationary member when said movable member is in a closed position;

said rail means of a first of said members being on the side of said cross bars adjacent the second of said members and said rail means of said second member being on the side of said cross bars opposite said first member, said center rail of said first member forming tongue and groove sliding connections with said second member, whereby said cross bars of said first member closely approach said cross bars of said second member;

longitudinal slots at opposed positions in said opposed center rails; and a magnet disposed in each of said slots for holding said movable member in an adjusted position.

2. A shutter, grille or the like as set forth in claim 1, wherein:

each of said magnets has a length in excess of the distance of movement of said movable member between said open and closed positions.

3. A shutter, grille or the like as set forth in claim 1, wherein:

the length of said magnets exceeds twice the distance of movement of said movable member between said open and said closed positions.

4. A shutter, grille or the like as defined in claim 1, wherein:

said rail means of one of said members includes an up- right rail at each side thereof; and said stationary and movable members are mounted in a frame having an inwardly extending tongue on each side engaging a groove in said side rails of said first member.

5. A shutter, grille or the like, comprising:

a stationary member having vertically and equally spaced cross bars;

a movable member provided with corresponding vertically and equally spaced cross bars, said cross bars of said movable member being in alignment with said cross bars of said stationary member when said movable member is in an open position and said cross bars of said movable member covering the spaces between said cross bars of said stationary member when said movable member is in a closed position;

a first of said stationary and movable members is provided with an upright center rail and upright side rails on the side of said cross bars adjacent the second of said members;

the second of said movable and stationary members is provided with an upright center rail and upright side rails on the side opposite the cross bars of the first said member;

said cross bars of said second member are provided with laterally extending tongues engaging grooves in said rails of said first member, whereby said tongue cross bars approach closely the cross bars of the first member and said center rails closely approach each other; and magnets mounted in opposed elongated, upright slots of opposing upright center rails of said members to hold said movable member in an adjusted position.

6. A shutter, grille or the like as set forth in claim 5, wherein:

said cross bars of each of said members are integral with the rails of said member.

* * * * *